US005395179A

United States Patent [19]

Kotani

[11] Patent Number: 5,395,179

[45] Date of Patent: Mar. 7, 1995

[54] SNOW MELTING DEVICE

[75] Inventor: Tetuho Kotani, Osaka, Japan

[73] Assignee: Nihon Kyoryo Kabushikikaisha, Osaka, Japan

[21] Appl. No.: 70,297

[22] Filed: Jun. 2, 1993

[51] Int. Cl.[6] ..... E01C 7/00

[52] U.S. Cl. ..... 404/71; 404/77; 404/79; 219/213; 219/544

[58] Field of Search ..... 404/17, 71; 165/45; 219/213, 528

[56] References Cited

U.S. PATENT DOCUMENTS 3,904,847 9/1975 Adams ..... 219/213
4,118,137 10/1978 LaGrone et al. ..... 404/17
4,518,851 5/1985 Oppitz ..... 219/528
4,564,745 1/1986 Deschenes ..... 219/213
4,880,051 11/1989 Ohashi ..... 165/45
5,023,428 6/1991 Hegstad ..... 219/213

*Primary Examiner*—Ramon S. Britts
*Assistant Examiner*—Pamela O'Connor
*Attorney, Agent, or Firm*—Nikaido, Marmelstein, Murray & Oram

[57] ABSTRACT

A snow melting device which includes a plurality of heating bodies arranged at intervals perpendicularly to the direction of traffic running and pedestrians walking on the road, each heating body including a planar heat generating element having at least a load bearing side thereof coated with a protective layer and having a terminal for connection to a power source.

1 Claim, 3 Drawing Sheets

SNOW MELTING DEVICE

FIELD OF THE INVENTION

The present invention relates generally to a snow melting device, and more particularly to a snow melting device, commonly called "road heating device", for installment in roadway and pavements, the device including a planar heat generating element for removing snow fall on roadway and pavements and avoiding freezing thereon. In this specification, the "road" includes roadways for cars to travel on and pavements for people to walk on.

BACKGROUND OF THE INVENTION

A snow melting device is known in the art which is designed to melt snow and prevent freezing. The known device uses resisting linear elements such as nichrome wires sandwiched between coverings such as asphalt mortar layers in which the wires are arranged in a zigzag form. The manufacturing process requires at least three steps:

(1) to arrange the resisting elements on a first asphalt mortar layer;

(2) to pour another dose of asphalt mortar onto the resisting elements laid on the first layer so as to form a heating body; and (3) to place a slab on the heating body wrapped in the asphalt mortar layers. Then the wrapped heating body is laid under the ground.

The following disadvantages have resulted:

Since the manual assembling work takes a long time, the asphalt mixture cools down before it is hardened enough. This results in the fragility of the roads. A fragile road causes the frequent breakage of the resisting elements.

In general, a protective layer such as of asphalt mixture requires a thickness of at least 25 mm sufficient to withstand traffic load, thereby increasing the weight of the road itself. In addition, the linear resisting elements have a relatively large thickness which result in rugged outward surfaces when they are wrapped in covering. When the protective layer is made of synthetic rubber, it is liable to deformation and breakage under traffic load. The fragile road surfaces cannot withstand traffic load, thereby causing the breakage of the inside resisting elements. It is difficult to find a broken spot of the resisting element in the coverage of the protective layers. It is particularly disadvantageous that a mechanical tool such as a finisher and a dumper cannot be used in assembling and installing the snow melting device under the ground.

SUMMARY OF THE INVENTION

According to the present invention, there is a snow melting device which includes a plurality of heating bodies arranged at intervals perpendicularly to the direction of traffic running on the road, each heating body comprising a planar heat generating element having at least a load bearing side thereof coated with a protective layer and having a terminal for connection to a power source.

Thus, the invention described herein has advantages of providing a snow melting device of light weight which is capable of easy transportation to installing sites, and of providing a snow melting device which can be flush with the ground surface, thereby reducing the possibility of breakage of the inside heat generating elements.

These and other advantages of the present invention will become apparent to those skilled in the art upon reading and understanding the following detailed description with reference to the accompanying figures.

BRIEF DESCRIPTION OF THE DRAWINGS

This invention may be better understood and its numerous objects and advantages will become apparent to those skilled in the art by reference to the accompanying drawings as follows.

DETAILED DESCRIPTION OF THE PREFERRED EMBODIMENT

Figure 1:
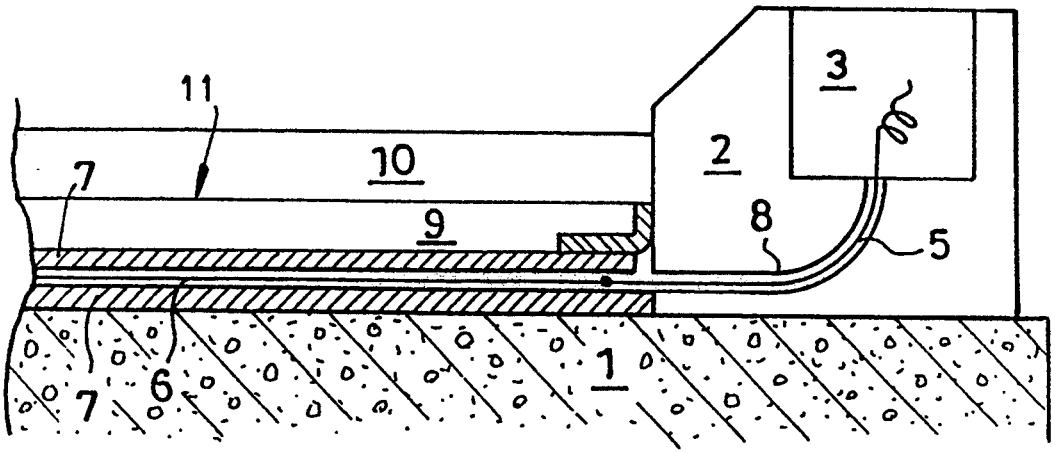
FIG. 1 is a diagrammatic cross-section showing a snow melting device according to the present invention when it is installed in the road.

Referring to FIG. 1, the exemplary snow melting device includes a plurality of heating bodies 11 arranged perpendicularly to the direction of traffic. The heating body 11 includes a heat generating element 6 and protective layers 7 covering the heat generating element 6. The heat generating element 6 is made by mixing carbon and thermoplastic resin so that the carbon may be dispersed in the thermoplastic resin and then by spreading same into a plate having a thickness 0.1 to 1 mm. The layer 7 is formed by applying several doses of rubber-asphalt paint to the heat generating element 6 until a desired thickness is obtained. The rubber-asphalt paint is obtained by adding 10 to 40% of synthetic rubber or synthetic resin to asphalt with the addition of powdery minerals. Before the paint is applied as the layers 7, it is heated into a molten state so that it can be easily applied to the heat generating element 6. The powdery minerals reinforces the layers 7. If the road condition permits, the rubber-asphalt paint can be applied to a load-bearing side alone of the heat generating element 6.

Figure 2:
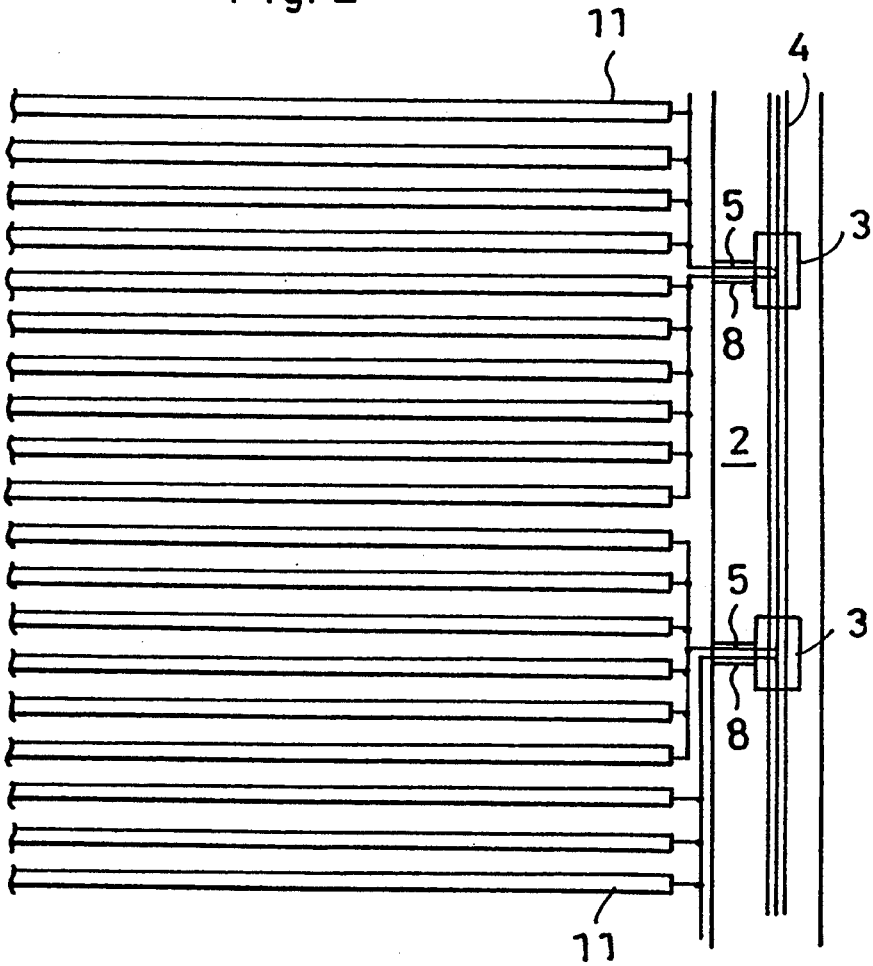
FIG. 2 is a diagrammatic plan view particularly showing electrical connection between the snow melting device and a source of power through mains.

As one example, the heating bodies 11 are arranged at intervals of 300 to 450 mm as shown in FIG. 2. The heat generating elements 6 are supplied with an a.c. current at three-phase 200 volts or 400 volts via branch lines 5 through branch boxes 3 which are connected to mains 4. Each heat generating element 6 has a width of 150 to 180 mm, and is sandwiched between the layers 7. The heating body 11 has a combined thickness of about 5 mm including the two layers 7. The length of the heating body 11 depends upon the width of a road in which the melting device is to be installed. Each heat generating element 6 is provided with terminals at one side for connection to the mains 4 through the terminal boxes 3.

Figure 3:
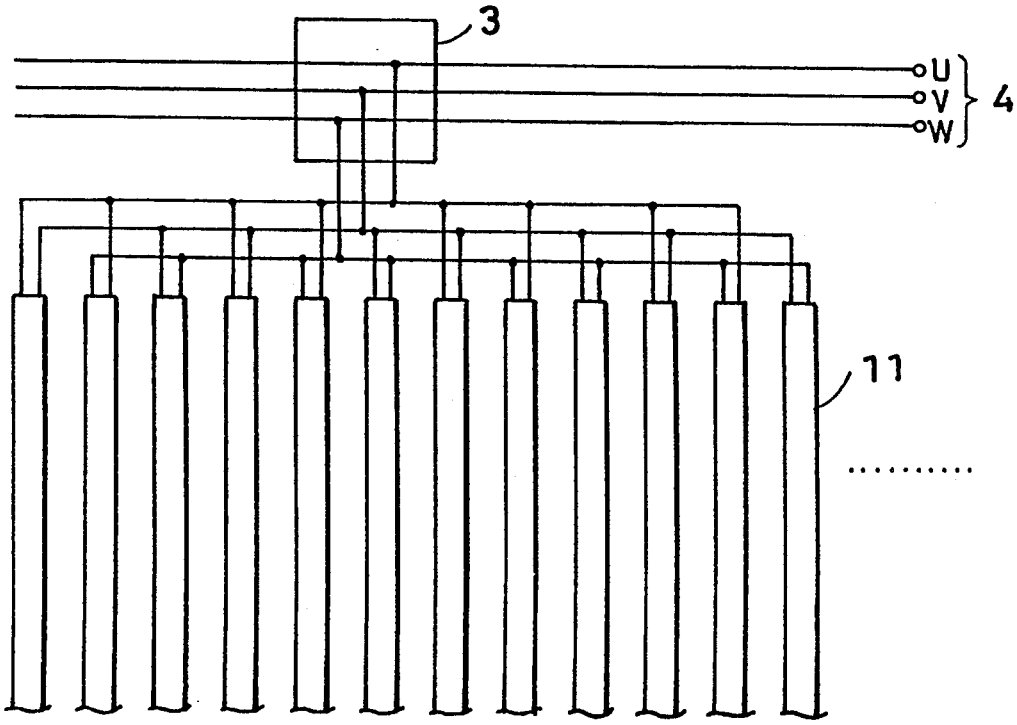
FIG. 3 is a diagrammatic plan view showing an example of electrical connection between the snow melting device and the mains.
Figure 4:
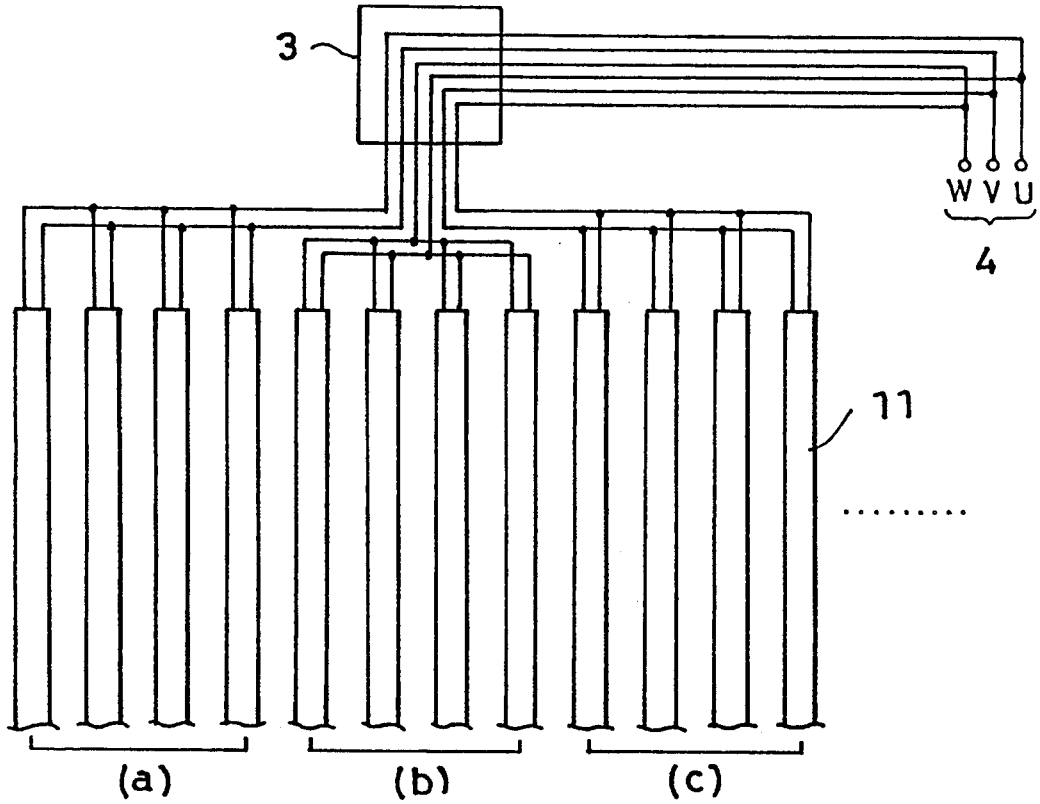
FIG. 4 is a diagrammatic plan view showing another example of electrical connection between the snow melting device and the mains.

As shown in FIG. 3, the heat generating elements 6 are electrically connected to the mains 4(U), 4(V), and 4(W). Alternatively, they can be connected to the mains 4(U), 4(V), and 4(W) as shown in FIG. 2. The example shown in FIG. 4 is characterized by the arrangement in which twelve heating bodies 11 are grouped into Groups (a), (b) and (c). Group (a) are connected to the mains 4(U) and 4(V), and Group (b) to the mains 4(U) and 4(W), and Group (c) to the mains 4(V) and 4(W). The number of the heating bodies 11 to be installed is determined by (3×integral number). This arrangement is advantageous in that any disconnection is easily found and repaired. The branch lines 5 and the lines connecting one terminal to other are covered with water-proof sheets 8.

After the heating bodies 11 are laid on the base 1, an outer covering 9 and an inner covering 10 are overlapped on the heating bodies 11. The power source is not limited to a three-phase a.c. current but a single phase a.c. current at 100 or 200 volts can be used.

Figure 5:
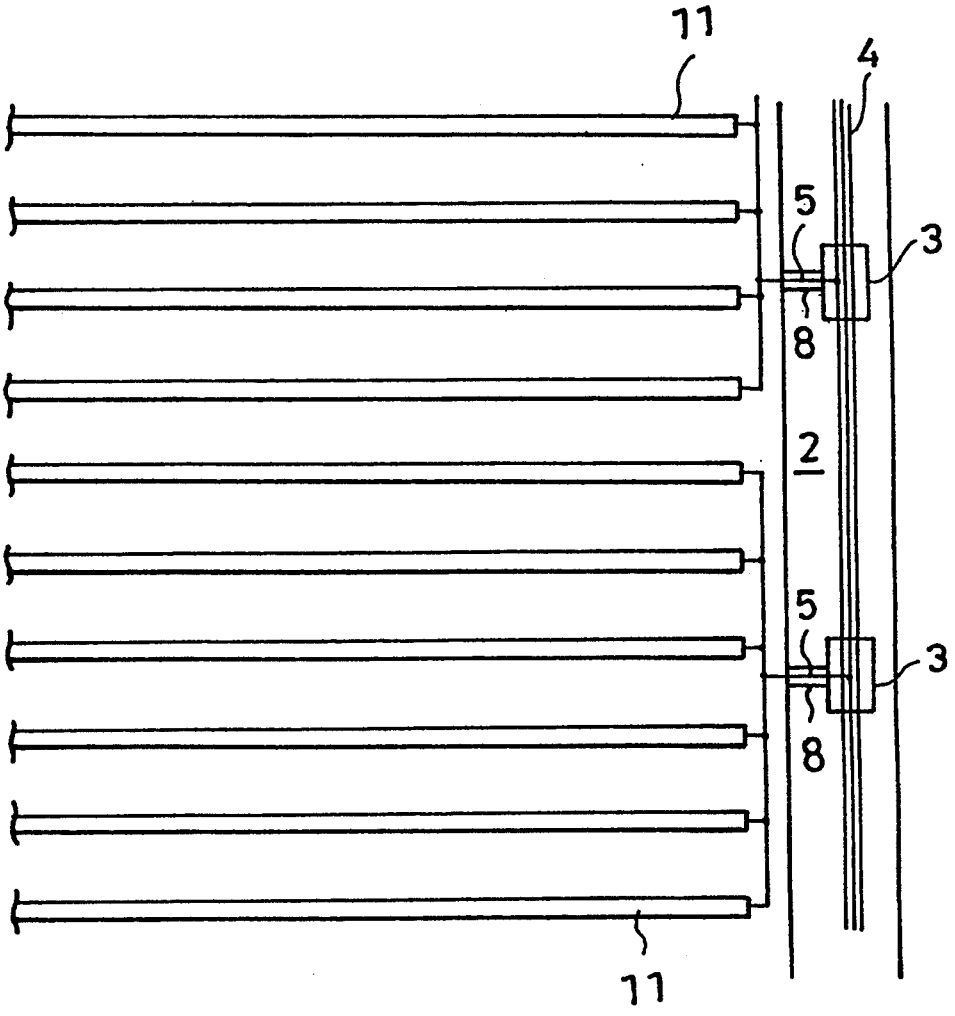
FIG. 5 is a diagrammatic plan view showing other example of arranging the heating bodies at relatively wide intervals.

FIG. 5 shows another arrangement characterized by wider intervals between adjacent heating bodies 11. The intervals are in a range of 600 to 900 mm. The intervals between the heating bodies 11 are determined road by road by taking into consideration the geographical conditions. The wide arrangement results in the reduction of the amount of electricity, thereby reducing the energy cost.

The snow melting device of the present invention can be applied to roadway, pavements, bridges, outdoor steps and verandas of individual homes, and any other sites which are subjected to snow fall and freezing.

What is claimed is:

1. A snow melting device for melting snow on a road comprising a plurality of heating bodies arranged at intervals perpendicularly to the direction of traffic running and pedestrians walking on the road;

wherein each heating body comprise a planar heat generating element made of a homogenous mixture of carbon and thermoplastic resin having at least a load bearing side thereof and having a terminal for connection to a power source and wherein said heat generating element has a thickness of approximately 0.1 to 1 mm; and a rubber asphalt protective layer comprising multiple layers overlaid on the load bearing side of the heat generating elements.

* * * * *